US012129782B2

(12) United States Patent
Lorenz et al.

(10) Patent No.: US 12,129,782 B2
(45) Date of Patent: Oct. 29, 2024

(54) EXHAUST GAS AFTER-TREATMENT DEVICE AND INTERNAL COMBUSTION ENGINE

(71) Applicant: Rolls-Royce Solutions GmbH, Friedrichshafen (DE)

(72) Inventors: Ingo Lorenz, Neuburg am Inn (DE); Manuel Lorenz, Rotthalmünster (DE); Simon Hölldobler, Ering (DE); Tobias Bieringer, Haarbach (DE); Dominik Kluiber, Egglham (DE); Dietmar Witzigmann, Wasserburg (DE); Andreas Moser, Ruhstorf (DE); Andreas Bruckmeier, Bad Füssing (DE); Julian Kovac, Schärding (AT); Helmut Hupfloher, Arnstorf (DE)

(73) Assignee: Rolls-Royce Solutions GmbH, Friedrichshafen (DE)

( * ) Notice: Subject to any disclaimer, the term of this patent is extended or adjusted under 35 U.S.C. 154(b) by 0 days.

(21) Appl. No.: 18/505,556

(22) Filed: Nov. 9, 2023

(65) Prior Publication Data

US 2024/0068389 A1 Feb. 29, 2024

Related U.S. Application Data

(63) Continuation of application No. PCT/EP2022/070843, filed on Jul. 25, 2022.

(30) Foreign Application Priority Data

Jul. 26, 2021 (DE) ..... 10 2021 119 276.5
Jul. 25, 2022 (WO) ..... PCT/EP2022/070843

(51) Int. Cl.
*F01N 13/00* (2010.01)
*F01N 3/20* (2006.01)
*F01N 3/30* (2006.01)

(52) U.S. Cl.
CPC ..... *F01N 3/2066* (2013.01); *F01N 3/206* (2013.01); *F01N 13/00* (2013.01); *F01N 3/30* (2013.01);
(Continued)

(58) Field of Classification Search
CPC ..... F01N 3/206; F01N 3/2066; F01N 3/208; F01N 2450/10; F01N 2590/10; F01N 2610/02
See application file for complete search history.

(56) References Cited

U.S. PATENT DOCUMENTS 11,066,971 B1 7/2021 Sharp
2004/0104577 A1 6/2004 Alger et al.
(Continued)

FOREIGN PATENT DOCUMENTS

EP 1 348 840 A1 10/2003
EP 1 493 482 A2 1/2005
(Continued)

OTHER PUBLICATIONS

Machine translation of EP 1348840 A1, accessed Mar. 7, 2024. (Year: 2024).*
(Continued)

*Primary Examiner* — Jonathan R Matthias
(74) *Attorney, Agent, or Firm* — Taylor IP, P.C.

(57) ABSTRACT

An exhaust gas after-treatment device includes: a catalytic converter system, which includes a delivery side and a discharge side; and a container including an interior space and at least two openings, the at least two openings including a first opening and a second opening, the catalytic converter system being arranged in the interior space of the container, the first opening being connected with the cata-
(Continued)

lytic converter system on the delivery side, and the second opening being connected to the catalytic converter system on the discharge side.

12 Claims, 4 Drawing Sheets

(52) U.S. Cl.
CPC ..... *F01N 2450/10* (2013.01); *F01N 2590/10* (2013.01); *F01N 2610/02* (2013.01)

(56) References Cited

U.S. PATENT DOCUMENTS

2012/0102929 A1* 5/2012 Beissler ..... F01N 13/002 60/297
2015/0240474 A1 8/2015 Kokoshka et al.
2017/0037764 A1 2/2017 Tonsich
2017/0342887 A1* 11/2017 McMakin ..... E06B 5/14
2020/0224981 A1* 7/2020 Martin ..... F01N 3/0205
2023/0303316 A1* 9/2023 Yan ..... F02B 63/044

FOREIGN PATENT DOCUMENTS

KR 2011-0111644 A 10/2011
WO 2018/031520 A1 2/2018

OTHER PUBLICATIONS

Machine English translation of KR 10-2011-011644 issued Oct. 12, 2011 (15 pages).
International Search Report and Written Opinion dated Nov. 21, 2022 for International Patent Application PCT/EP2022/070843 (16 pages).

* cited by examiner

EXHAUST GAS AFTER-TREATMENT DEVICE AND INTERNAL COMBUSTION ENGINE

CROSS REFERENCE TO RELATED APPLICATIONS

This is a continuation of PCT application no. PCT/EP2022/070843, entitled "EXHAUST GAS AFTERTREATMENT DEVICE AND INTERNAL COMBUSTION ENGINE", filed Jul. 25, 2022, which is incorporated herein by reference. PCT application no. PCT/EP2022/070843 claims priority to German patent application no. 10 2021 119 276.5, filed Jul. 26, 2021, which is incorporated herein by reference.

BACKGROUND OF THE INVENTION

1. Field of the Invention

The present invention relates to an exhaust gas after-treatment device and an internal combustion engine.

2. Description of the Related Art

Exhaust gas after-treatment devices and internal combustion engines are known from the current state of the art. In order to reduce pollutants in an exhaust gas of an internal combustion engine, such exhaust gas after-treatment devices are typically arranged in an exhaust gas system of the internal combustion engine. This makes it possible that the internal combustion engines and the therewith driven vehicles can adhere to the legally stipulated emission limits. Such limit value specifications are particularly widespread in car and truck traffic and have generally local and/or regional validity.

In addition there are also internal combustion engines which are used in a sector where no exhaust gas after-treatment is necessary and/or legally required. For financial reasons and/or to simplify the design of such internal combustion engines, exhaust gas after-treatment is often dispensed with. Nevertheless, it can be advantageous, at least at times—for example for ecological reasons and/or in order to prepare for anticipated changes in legal requirements or in particular to meet temporary, local exhaust emission protection requirements—to install an exhaust gas after-treatment device for such internal combustion engines.

Particularly with large, stationary internal combustion engines, more particularly with those that are installed immovably as a power plant, a temporary need may exist for exhaust gas after-treatment. This temporary need for exhaust gas after-treatment can result from seasonal and/or weather-related circumstances on the one hand, but also from changing legal framework conditions on the other hand.

The disadvantage of the known exhaust gas after-treatment device is that it is permanently connected to the internal combustion engine and therefore cannot be used in a flexible manner. In particular, flexible, temporary exhaust gas after-treatment is only possible if the exhaust gas after-treatment device is already present and can be switched on or off as required, for example via valves. As a result, the costs are very high, since every internal combustion engine whose pollutant emissions are to be reduced at least at times must have such an exhaust gas after-treatment device.

What is needed in the art is an exhaust gas after-treatment device, wherein the aforementioned disadvantages are avoided. In particular, what is needed in the art is an exhaust gas after-treatment device that can be used flexibly and to cut costs.

SUMMARY OF THE INVENTION

The present invention provides in particular an exhaust gas after-treatment device with a catalytic converter system and in particularly an accessible container, wherein the catalytic converter system is arranged in an interior space of the container, wherein the container has at least two optionally closable openings, wherein a first opening of the two openings is connected to the catalytic converter system on the delivery side, and wherein a second opening of the two openings is connected to the catalytic converter system on the discharge side. Thus, a flexibly usable exhaust gas after-treatment device is created which, if necessary, can be connected in particular by way of the first opening to an exhaust opening of an external internal combustion engine. When there is no longer a need for exhaust gas after-treatment, the exhaust gas after-treatment device can be separated from the internal combustion engine and can—separately from the latter—be transported and otherwise used, in particular for exhaust gas after-treatment in another internal combustion engine. This reduces production costs, since not every internal combustion engine requires its own exhaust gas after-treatment device.

A catalytic converter system is herein understood in particular to be a system which is designed and arranged to reduce pollutants in a supplied fluid, in particular in a gas mixture, especially in an exhaust gas.

The catalytic converter system optionally has at least one delivery path, one discharge path and at least one catalytic converter device which is arranged in direction of flow between delivery path and discharge path. The catalytic converter system is designed and set up in such a way that—in the operating state of the exhaust gas after-treatment device—an exhaust gas is supplied to the catalytic converter device on the delivery side, that is via the delivery path, wherein the supplied exhaust gas is after-treated in the catalytic converter device; in particular a pollutant component of the exhaust gas is being reduced. Downstream of the location of the exhaust gas after-treatment, in particular downstream of the catalytic converter device, the catalytic converter device is fluidically connected with the second opening on the downstream side, in other words via the discharge path. As a result, the after-treated exhaust gas can discharge via the discharge path and the second opening, and in particular can be led out of the container and expelled.

A container is herein understood to be in particular an accessible container which optionally has side walls, a floor and a top. Overall, the container is thus cuboid. The container is moreover designed to be weather resistant, so that it can be subjected to weather influences without additional protection and without components arranged in the inside being subjected to damage. In addition, the container is optionally designed and equipped to allow relocation of the container, in particular transport, with as little effort as possible. In particular, the container is designed as a standardized container, especially an ISO container. Such standardized containers are known, for example, from cargo traffic, in particular sea freight, air freight and trucking freight.

The catalytic converter system includes optionally several catalytic converter devices, in particular an oxidation catalytic converter and an SCR catalytic converter. As a result, exhaust gas after-treatment is improved, in particular in that one pollutant component and/or several different pollutant components in the supplied exhaust gas can be reduced even more. Alternatively, the catalytic converter system includes only one catalytic converter device, in particular an SCR catalytic converter, keeping overall cost and design complexity of the exhaust gas after-treatment device low.

The at least two openings are optionally designed to be closable, wherein the at least two openings are closed, particularly during transportation of the exhaust gas after-treatment device. In the operating state of the exhaust gas after-treatment device, the first opening is optionally open and connected to an external combustion engine on an outside of the container. The second opening is also open in the operating state and is arranged as an exhaust gas outlet for the after-treated exhaust gas. The at least two openings are optionally designed in an outer wall of the container, in particular in one or more of the four side walls, the floor and/or the top.

According to a further development of the present invention, the exhaust gas after-treatment device has a working platform which is arranged on a container top of the container. This allows easy assembly of components to be mounted on the container top.

The working platform optionally has a non-slip floor, thus increasing work safety. Furthermore, the working platform optionally has a hinged railing, which—particularly in the transport state—is folded up and placed against the container top and/or the working platform. This allows an overall height of the exhaust gas after-treatment device to be reduced, in particular for transport purposes, thus simplifying transportation.

Moreover, the exhaust gas after-treatment device optionally has a ladder which can be arranged, in particular is arranged, in such a way that the working platform can be ascended with the aid of this ladder.

According to a further development of the present invention, it is provided that the exhaust gas after-treatment device includes an exhaust gas stack which—at least in one operating state of the exhaust gas after-treatment device—is mounted outside the container at the second opening. This provides efficient removal of the after-treated exhaust gas and renders an external exhaust gas stack superfluous. In addition, the exhaust gas stack is optionally not mounted in the transport state, so that the exhaust gas after-treatment device as a whole can be transported with little effort, the exhaust gas after-treatment device having a comparatively low height.

The exhaust gas after-treatment device further includes optionally a connecting member which is designed and arranged to connect the first opening to an external internal combustion engine. In particular, in the operating state, the first opening is connected to an exhaust gas discharge opening of the external internal combustion engine via the connecting element. This allows the exhaust gas from the external internal combustion engine to be delivered directly into the exhaust gas after-treatment device, where it can be after-treated by the catalytic converter system.

Optionally, the container has at least one maintenance opening, in particular a maintenance door. This means that the components arranged in the interior of the container, in particular the catalytic converter system, are at least partially accessible and/or replaceable from the outside. Optionally, the container has a large maintenance door on each of its narrow end faces, which is optionally designed as a double door. This means that large components, in particular entire components of the catalytic converter system, can be removed from the container in the event of maintenance. Said components can in particular be replaced via these maintenance doors in the event of a defect.

According to a further development of the present invention, it is provided that the container has at least one rail arrangement, wherein at least part of the catalytic converter system is movably arranged on the rail arrangement. This makes it easier to relocate the catalytic converter system, in particular for maintenance purposes. In particular, the catalytic converter system can be at least partially moved out of the container and/or replaced by way of the rail arrangement. This simplifies maintenance and repair of the exhaust gas after-treatment device.

According to a further development of the present invention, it is provided that the catalytic converter system has a fresh air supply device for supplying fresh air, wherein the fresh air supply device has a first flow opening which is fluidically connected at least indirectly to the catalytic converter system, optionally the catalytic converter device, and wherein the fresh air supply device has a second flow opening which is designed and arranged for fluidic connection to a fresh air source, and is in particular fluidically connected with same. Fresh air can thus be added to the supplied exhaust gas, which means that in particular technical, chemical and/or statutory temperature limits can be complied with during exhaust gas after-treatment. Moreover, the addition of fresh air makes it possible to control a reaction temperature of the catalytic reactions for exhaust gas after-treatment and optionally to keep it in a target range in which the exhaust gas to be after-treated, in particular individual gas components of the exhaust gas, can be after-treated particularly efficiently. In addition, by adding fresh gas, a reaction environment, in particular a reaction temperature, can be set which favors individual exhaust gas after-treatment reactions in such a way that they are intensified. In particular, this prevents the catalytic converter system and device from overheating to such an extent that exhaust gas after-treatment would deteriorate. In particular, this allows different types of internal combustion engines to be connected to the exhaust gas after-treatment device and their exhaust gases to be effectively after-treated.

The amount of fresh air supplied is optionally determined depending on the connected internal combustion engine, so that optimum pollutant reduction in the exhaust gas is always ensured. This also improves the flexibility of use of the exhaust gas after-treatment device.

Fresh air source is understood herein to be in particular an environment of the container, in particular the atmosphere. Alternatively, it is understood to be a fresh air reservoir, optionally designed as a fresh air storage device. Such a fresh air reservoir is optionally a component of the exhaust gas after-treatment device and is arranged in its interior space, thereby allowing fresh air to be supplied independently of the external atmosphere, so that the exhaust gas after-treatment device can also be used in environments in which no fresh air or too little fresh air is available.

A further development of the present invention provides that at least one axial fan, in particular a frequency-controlled axial fan, is arranged in a wall of the container for the purpose of room temperature control and is designed and set up to generate an air flow between the interior space and the fresh air source, in particular an external environment of the container. This prevents overheating of the interior space and components arranged therein. A fresh air supply is thus also provided for the interior space of the container, allowing people to be in the container without danger and risk of suffocation.

According to a further development of the present invention, it is provided that the catalytic converter system includes an SCR catalytic converter, wherein at least one reservoir for a reducing agent is arranged in an interior space of the container, said reservoir being connected to the catalytic converter system via a reducing agent supply line. As a result, the exhaust gas after-treatment device includes all parts that are relevant for after-treatment of the supplied exhaust gas by way of the SCR catalytic converter and for breaking down pollutants contained in the exhaust gas. In particular, the reducing agent thus does not have to be supplied externally. This means that the exhaust gas after-treatment device can be used flexibly and is quickly ready for use after a change of location.

An SCR catalyst refers herein, in particular, to a catalyst which is designed and arranged for selective catalytic reduction of an exhaust gas component, in particular nitrogen oxides of the exhaust gas.

Optionally, the at least one reducing agent reservoir is accessible and/or replaceable via the maintenance doors, in particular the front-side maintenance doors.

Optionally, two IBC containers (intermediate bulk containers), in particular of equal size, are used as the at least one reducing agent reservoir, wherein each of the reducing agent reservoirs, in particular each of the IBC containers, optionally has a capacity of between 500 and 4000 liters, optionally 1000 liters. In addition, the interior is optionally twice as wide as one IBC container, so that the two IBC containers can be arranged next to each other to save space.

The reducing agent reservoir is optionally arranged in the interior space on one end face of the container, so that it is easily accessible via one of the end-face maintenance openings, in particular for refueling purposes, and can optionally be removed from the interior and thus replaced.

A fluid containing urea is optionally used as reducing agent. Optionally, a urea solution is used as reducing agent.

A further development of the present invention provides that a compressed air device is arranged in the interior space for injecting a reducing agent, wherein the compressed air device is operatively connected to the reducing agent supply line. Thus, the reducing agent can be injected into the catalytic converter system at a suitable pressure. Since the exhaust gas pressure of the supplied exhaust gas can vary depending on the type of external combustion engine connected, the exhaust gas after-treatment device can be used flexibly and in combination with a large number of different combustion engines.

The compressed air device optionally has a compressor and a compressed air reservoir. This provides a constant pressure and prevents pressure fluctuations during injection.

The reducing agent supply line optionally opens into an airline supplied with compressed air. The reducing agent is thus carried along by the compressed air in the compressed air line and supplied to the delivery path and/or directly to the catalytic converter device.

Moreover, a metering device is optionally arranged in the interior, which is designed and arranged to meter a reducing agent into the catalytic converter device. In this way, the exhaust gas after-treatment device can always be adapted to changing external circumstances, in particular to different types of external combustion engines.

In accordance with a further development of the present invention, it is provided that a controller which is designed and equipped for controlling the catalytic converter system is arranged in the interior space. Consequently, no additional controller is required and the controller needed for controlling the catalytic converter device is always transported together with the exhaust gas after-treatment device. The control unit is optionally arranged in a walk-in part of the container, in particular in a control room. Thus, the exhaust gas after-treatment device can be controlled by someone in the container, whereby in particular the individual and the control unit are protected from the weather.

The controller is optionally designed and equipped to set a metering volume of the reducing agent and/or an injection pressure of the compressed air device, in particular depending on the internal combustion engine and/or the delivered exhaust gas, especially its chemical composition. Setting of the suitable metering volume occurs thereby optionally automatically, in particular by measuring an exhaust gas pressure and/or the chemical composition in the delivery path, and/or manually by a person. As a result, the exhaust gas after-treatment device can be used flexibly and in combination with a large number of different internal combustion engines, wherein optimum exhaust gas after-treatment tailored to the respective exhaust gas can always be set.

The exhaust gas after-treatment device and especially the controller are designed and arranged to adjust the exhaust gas after-treatment for a plurality of different internal combustion engines. For this purpose, engine-specific data sets and/or maps for exhaust gas after-treatment can optionally be stored in the control unit. These can be easily selected by the controller in order to always set a suitable and optimum exhaust gas after-treatment for the respectively connected internal combustion engine.

The control unit is optionally designed and arranged to provide the reducing agent depending on a reducing agent type, in particular to meter it and/or to adjust the injection pressure. The reducing agent reservoir can therefore be filled with different types of reducing agent, wherein a suitable, in particular optimum, metering volume and/or injection pressure can always be adjusted by way of the controller.

A further development of the present invention provides that the exhaust gas after-treatment device is designed as a vehicle or as a vehicle trailer. As a result, the exhaust gas after-treatment device can be used in an especially flexible manner and can be moved quickly and with little effort from one operating site to another operating site.

The vehicle trailer is optionally designed as a truck trailer. Moreover the vehicle trailer and/or the vehicle is optionally equipped with an assembly crane. By way of this assembly crane, the exhaust gas stack and/or the connecting element can be mounted in particular on the first and/or second opening in a simple manner.

The present invention also provides an internal combustion engine with an exhaust gas after-treatment device according to one of the aforementioned design examples, wherein an exhaust gas outlet of the internal combustion engine is fluidically connected to the first opening of the exhaust gas after-treatment device. This provides the advantages already previously discussed in connection with the design examples of the exhaust gas after-treatment device.

The discussed—in particular external—internal combustion engine is optionally designed as a reciprocating engine. One design example of the internal combustion engine is optionally also used in a stationary situation, for example for stationary power supply in emergency power operation, continuous load operation or peak load operation, in which case the internal combustion engine optionally drives a generator. A stationary application of the internal combustion engine for driving auxiliary power units, for example fire pumps on oil rigs, is also possible. Furthermore, an application of the internal combustion engine in the field of the extraction of fossil raw materials and in particular fuels, for example oil and/or gas, is possible. It is also possible to use the internal combustion engine in the industrial sector or in the field of construction, for example in a construction or building machine, for example in a crane or an excavator. The internal combustion engine is optionally designed as a diesel engine, a gasoline engine, a gas engine for operation with natural gas, biogas, special gas or another suitable gas or a synthetic fuel. In particular, if the internal combustion engine is designed as a gas engine, it is suitable for use in a cogeneration plant for stationary power generation.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

Figure 1:
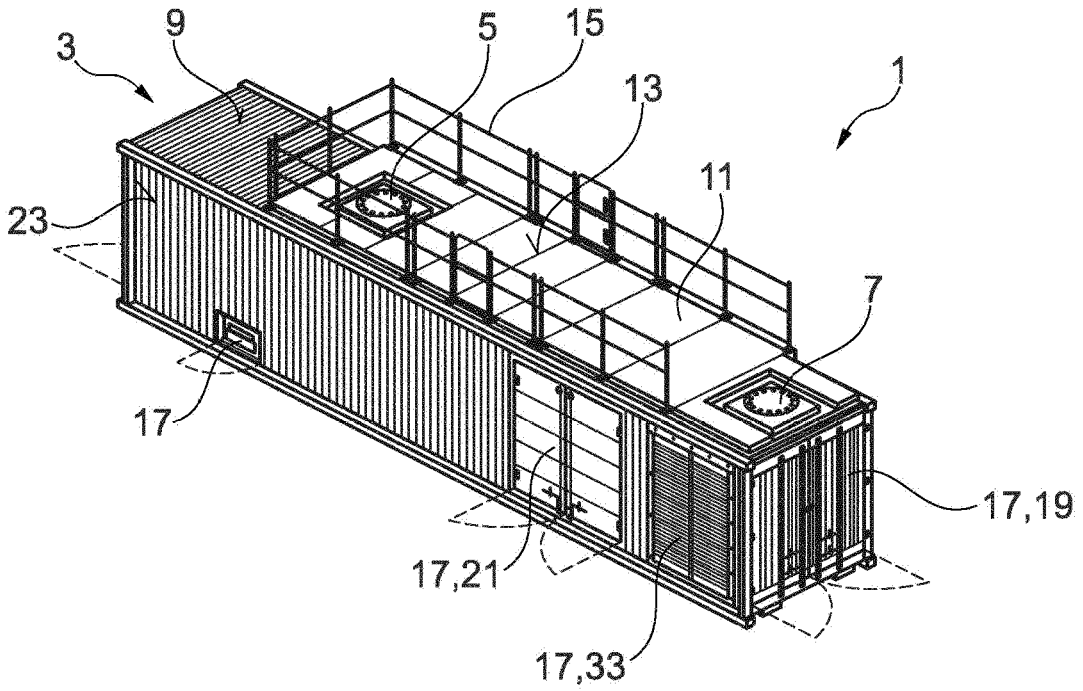
FIG. 1 is a perspective view of an exhaust gas after-treatment device.

FIG. 1 shows an exhaust gas after-treatment device 1 with a container 3, in the interior of which a catalytic converter system which is not shown in FIG. 1 is arranged. Container 3 has at least two openings, in this case a first opening 5 and a second opening 7. The catalytic converter system arranged in the interior space of container 3 can be connected to an externally located internal combustion engine, in particular to an exhaust gas opening of the externally located internal combustion engine, via first opening 5. This creates an exhaust gas after-treatment device 1 that can be used flexibly. This can be connected to a large number of different externally located internal combustion engines and used in after-treatment of their exhaust gases, in particular reducing the pollutants contained therein.

Both openings, that is first opening 5 and second opening 7, are optionally designed to be closable and are closed in the state shown here.

In addition, exhaust gas after-treatment device 1 can be easily transported by way of container 3. Container 3 is optionally designed as a standardized container, in particular as an ISO container. In any case, container 3 optionally has dimensions customary for freight, so that it can be handled by way of known freight infrastructures, in particular freight cranes and freight transporters.

Furthermore, it can be seen in FIG. 1 that a work platform 11 is arranged on a container top 9 of container 3. Working platform 11 optionally includes a non-slip floor 13 and a foldable railing 15, which is shown here in an unfolded state. In a folded state which is not shown here, railing 15 optionally rests against container top 9, wherein railing 15 in this folded state can optionally be attached to container top 9 in a transport-safe manner.

By folding in railing 15, the overall height of exhaust gas after-treatment device 1 is reduced so that entire exhaust gas after-treatment device 1—in particular after loading onto a truck trailer—does not exceed maximum heights typical for road traffic. Thus, exhaust gas after-treatment device 1 can be transported by known truck trailers in normal road traffic. In particular, this avoids special or heavy transport measures and/or special permits for transportation.

With the exception of erected railing 15 the illustrated state of exhaust gas after-treatment device 1 shown in FIG. 1 is consistent with a transport state of exhaust gas after-treatment device 1. In particular, first opening 5 and second opening 7 are closed during transport of exhaust gas after-treatment device 1. In addition, in the transport state railing 15 is folded, in particular placed against working platform 11 and/or container top 9 and mounted thereto in a transport-safe manner.

FIG. 1 also shows several maintenance openings 17, here in particular four maintenance openings. Two of these maintenance openings, namely a front double door 19 and a side double door 21, are designed in such a way that the container can be accessed by maintenance personnel through these double doors. Furthermore, these large maintenance openings 17, in particular double doors 19, can also be used to remove and/or replace large components inside container 3, in particular for maintenance purposes.

Figure 2:
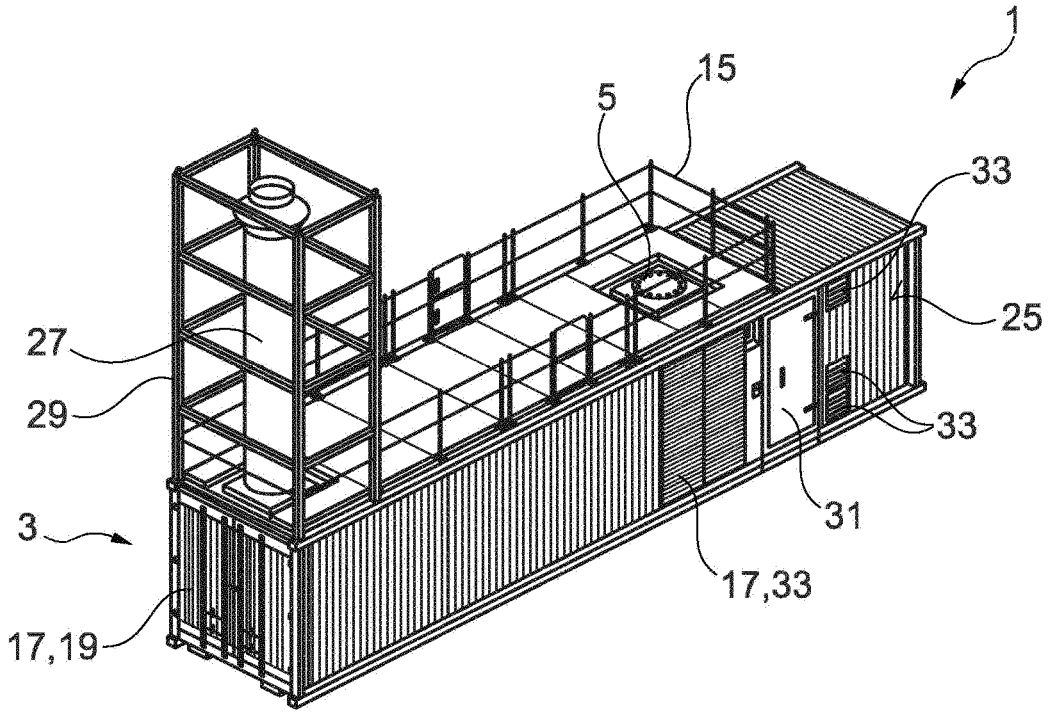
FIG. 2 is a rotated view of the exhaust gas after-treatment device shown in FIG. 1 with a mounted exhaust gas stack.

FIG. 2 shows exhaust gas after-treatment device 1 shown in FIG. 1 in a representation rotated clockwise by approx. 90° compared with FIG. 1, so that a second long side 25 opposite a first long side 23 shown in FIG. 1 can be seen here. Unlike in FIG. 1, second opening 7 is no longer closed in this illustration. Rather, exhaust gas stack 27 is mounted here at second opening 7, via which the after-treated exhaust gases—after passing through the catalytic converter system—are emitted.

Exhaust stack 27 is further attached to a support frame 29. This increases the stability of exhaust stack 27. Furthermore, the assembly of exhaust stack 27 is thereby also simplified, in particular in that exhaust stack 27 and/or support frame 29 are attached to container 3, in particular container top 9, by way of at least one attachment structure, most particularly by way of a twist lock attachment.

In addition, manageability of exhaust stack 27 is improved in that exhaust stack 27 is firmly connected to support frame 29. Thus, exhaust stack 27 can be gripped and adjusted during assembly by way of support frame 29. In addition, since support frame 29 surrounds exhaust stack 27 in the circumferential direction, damage to exhaust stack 27 is avoided, particularly during assembly and transport.

FIG. 2 also shows additional maintenance openings 17, in particular a maintenance door 31, through which container 3 can be accessed by maintenance personnel and/or for controlling exhaust gas after-treatment device 1. Some of the maintenance openings 17 are designed as air-permeable ventilation openings 33—even when closed—for ventilation of the interior space. Moreover, additional small ventilation openings 33 can be seen to the right of maintenance door 31 in FIG. 2.

Figure 3:
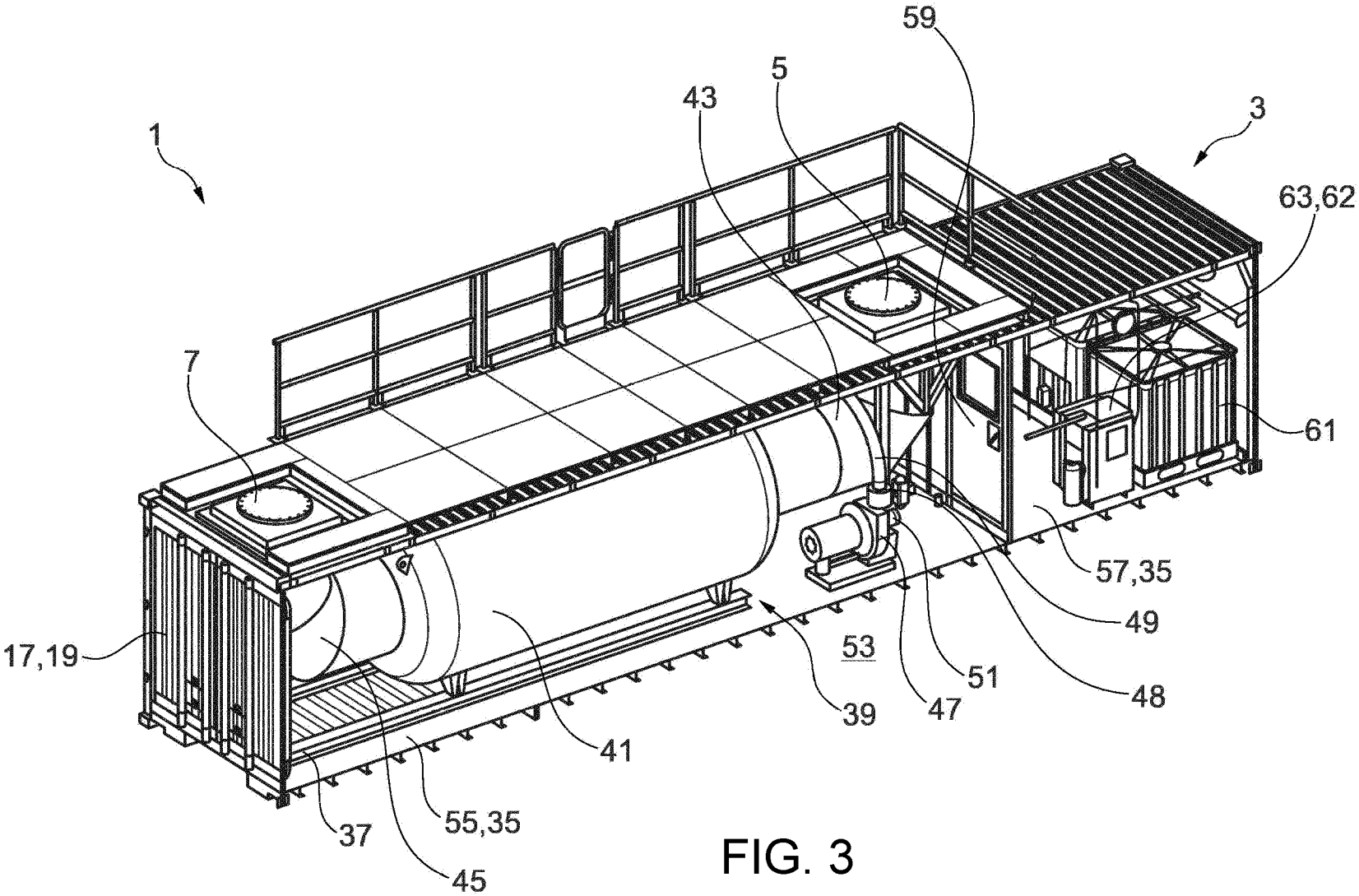
FIG. 3 is a perspective sectional view of the exhaust gas after-treatment device, in particular the interior of the container.

FIG. 3 shows a perspective sectional view of exhaust gas after-treatment device 1, with second long side 25 facing the viewer in FIG. 2 cut away. Thus it can be seen that rail arrangement 37 is located in an interior space 35 of container 3, on which a part of catalytic converter system 39, in this case specifically catalytic converter device 41, is arranged in a movable manner. Thus, at least part of catalytic converter system 39, in particular catalytic converter device 41, optionally the entire catalytic converter system 39, can be moved out of container 3 by rail arrangement 37 with little effort via double door 19 on the end face, simplifying maintenance of catalytic converter system 39.

The catalytic converter system shown in FIG. 3 optionally includes an SCR catalytic converter. Particularly optionally, the catalytic converter system also includes an oxidation catalytic converter and/or other catalytic converter types. This permits particularly comprehensive exhaust gas after-treatment, with the pollutants in the exhaust gas being largely degradable.

In contrast to the state of exhaust gas after-treatment device 1 shown in FIG. 2, exhaust gas stack 27 in FIG. 3 is not mounted ready for operation at the second opening 7.

Instead, second opening 7 and first opening 5 are closed—as is the case in the state shown in FIG. 1.

FIG. 3 further shows that catalytic converter device 41, which is fluidically arranged between first opening 5 and second opening 7, is fluidically connected to first opening 5 on the delivery side via a delivery path 43 and to second opening 7 on the discharge side via a discharge path. Exhaust gas after-treatment device 1 is therein designed and arranged to deliver an exhaust gas supplied via first opening 5 to—in particular an external internal combustion engine of catalytic converter system 39, in particular to catalytic converter device 41, and—after a catalytic reaction for reducing pollutants in catalytic converter device 41—to pass the after-treated exhaust gas on to second opening 7 via second flow path 45 and to eject it there, in particular via an exhaust gas stack 27 connected to second opening 7.

Catalytic converter system 39 optionally has a fresh air supply device 47, which is at least indirectly fluidically connected to catalytic converter device 41 via a first flow opening 48 of fresh air supply device 47. The supplied air is blown into delivery path 43 via a connecting duct 49. Fresh air supply device 47, which is herein designed in particular as a fresh air blower, is arranged and designed to receive fresh air from a fresh air source via a second flow opening 51. Fresh air source 53 is thus optionally provided by an environment of container 3, in particular the atmosphere.

The volume of fresh air supplied is optionally determined manually or automatically depending on an internal combustion engine which is connected to exhaust gas after-treatment device 1. Thus, exhaust gas after-treatment device 1 can be used in combination with a multitude of different internal combustion engines, whereby the various exhaust gases of the different internal combustion engines can be effectively after-treated and the pollutants contained therein can be reduced by setting a suitable amount of fresh air to be supplied.

Fresh air supply device 47 is arranged here in particular adjacent to a maintenance opening 17 which is designed as a ventilation opening 33 and is optionally fluidically connected to the latter. Thus fresh air can be drawn directly via fresh air supply device 47 from outside of container 3.

Interior space 35 of container 3 represented herein is divided in particular into two subspaces, namely a catalytic converter space 55 and a control room 57. The two spaces are essentially separated from one another by a partition wall, wherein a door 59 is arranged in the partition wall, as a result of which someone can alternate between catalytic converter space 55 and control room 57 without having to leave container 3. As a result, work safety is increased, and the noise exposure to personnel in control room 57 is reduced.

In addition, at least one reducing agent reservoir 61—in this case particular two IBC containers which can be filled with a reducing agent, in particular filled IBC containers—is arranged in interior space 35, in this case in control room 57. A urea solution is optionally used as reducing agent. This reducing agent reservoir 61 is connected to catalytic converter system 39 via a reducing agent supply line. For pressurized injection of the reducing agent, compressed air device 62 is also arranged in interior space 35 and is operatively connected to the reducing agent supply line.

Figure 4:
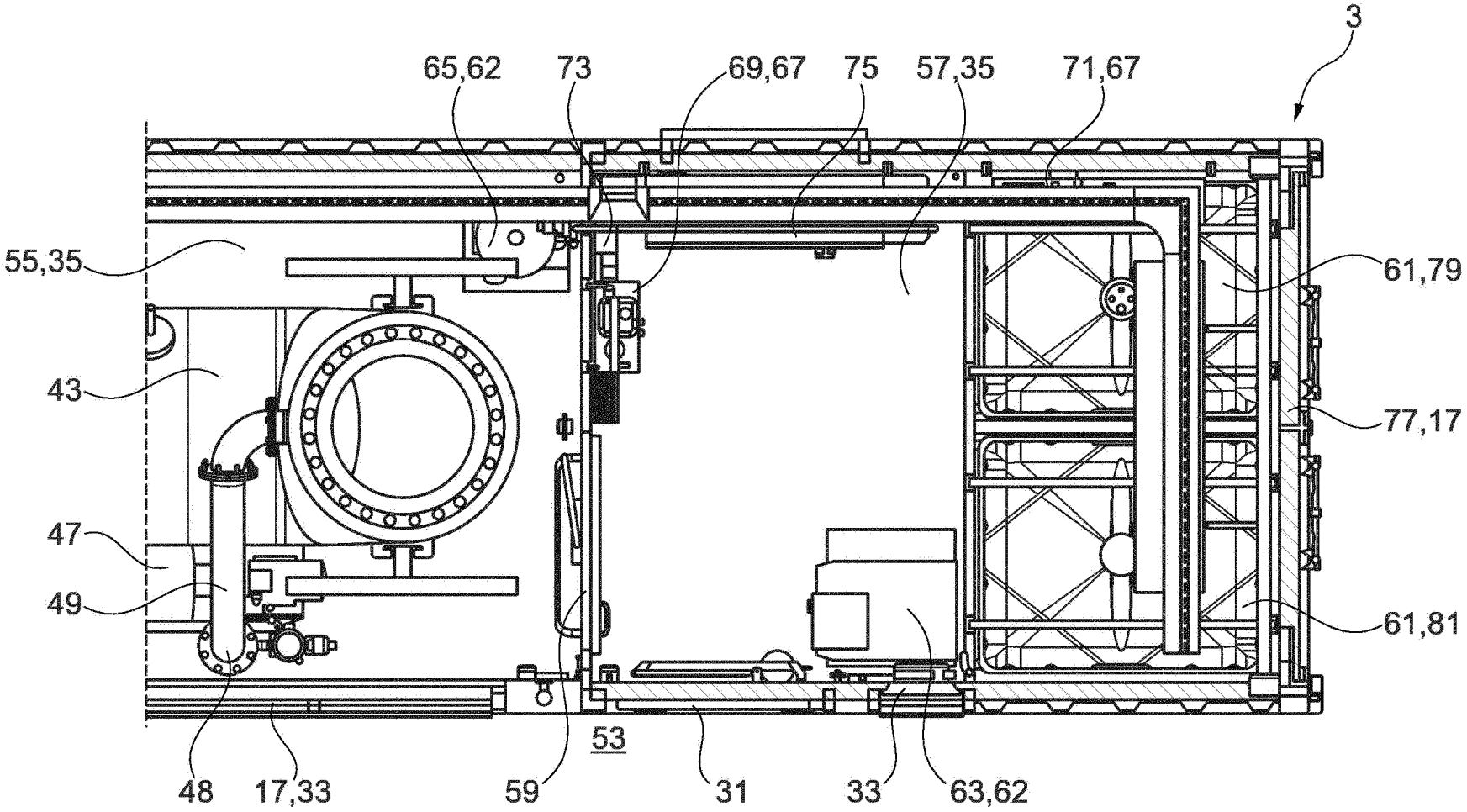
FIG. 4 is a first part of the exhaust gas after-treatment device in a sectional top view.

As can also be seen in FIG. 4 in a top view of a section of interior space 35, in particular of control room 57 and a section of catalytic converter space 55, a compressed air reservoir 65 is arranged in catalytic converter space 55, wherein compressed air reservoir 65 is operatively connected to compressor 63 which is located in the control chamber in such a way that compressed air reservoir 65 can be acted upon by a pressure generated by compressor 63.

Compressed air device 62 is thereby operatively connected as a whole to the reducing agent supply lines in such a way that a reducing agent flowing through the reducing agent supply lines can be acted upon by compressed air and can thereby be injected into catalytic converter device 41 and/or delivery path 43.

For metering the reducing agent, a metering device 67 is also arranged in control room 57, which has at least one metering device 69 and a metering pump 71. Metering pump 71 is designed and arranged to pump reducing agent from reducing agent reservoir 61 and to supply it to metering unit 69 via a connection line 73.

In conjunction with a controller 75 arranged in control room 57, a metering volume can optionally be selected—depending on the type of internal combustion engine that can be connected and is intended for connection—which is metered accordingly by metering device 69 and supplied, in particular under pressurization to delivery path 43 and/or to catalytic converter device 41 with the aid of compressed air device 62.

Both reducing agent reservoirs 61, which are designed in this case as IBC containers, are optionally dimensioned in such a way that two of these reducing agent reservoirs 61 can be arranged along a short side of container 3 to fit precisely into interior space 35, here in particular into control room 57. In this manner, the space in container 3 is used effectively and a large volume of reducing agent is provided.

Reducing agent reservoir 61 can be removed in its entirety from container 3 and/or can be refueled from outside of container 3 via a further maintenance opening, which is designed herein as an additional front end double door 77.

The reducing agent is optionally pumped out of a first IBC container of the two IBC containers by way of metering pump 71, wherein a second IBC container of the two IBC containers is fluidically connectable, and is in particular connected, to the first IBC container and functions as a reserve container. In this case, the second IBC container is optionally fluidically connected to the first IBC container via an attached refill pump and optionally a dispensing nozzle and is designed to refill the first IBC container as needed. This creates a largely continuous supply of reducing agent. In particular, reducing agent can thus also be refilled during operation of exhaust gas after-treatment device 1.

Overall, controller 75 is also designed and arranged to control catalytic converter system 39. This provides at least partially automated control of catalytic converter system 39. In particular, exhaust gas after-treatment device 1 can thereby be operated in conjunction with different types of internal combustion engines, wherein the exhaust gases of the different types of internal combustion engines can each be effectively after-treated by way of exhaust gas after-treatment device 1.

Figure 5:
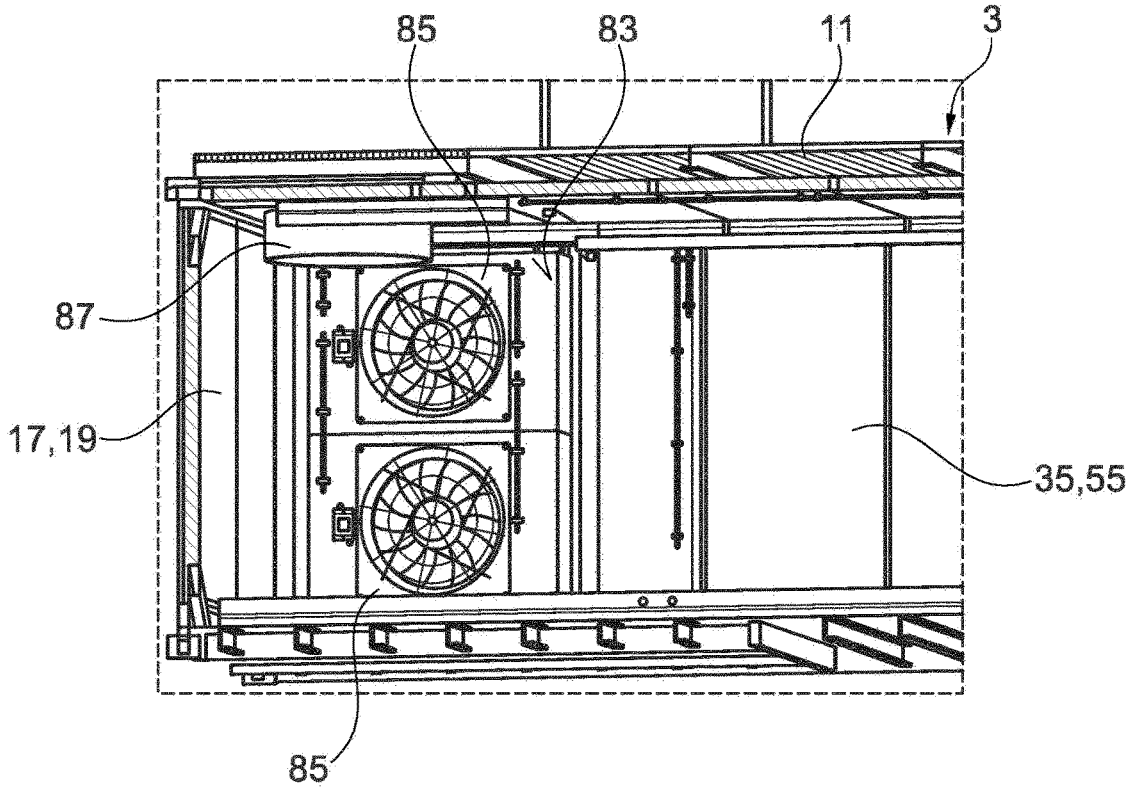
FIG. 5 is a perspective sectional view of a second part of the exhaust gas after-treatment device.

FIG. 5 is a representation of a wall 83 of container 3 in which at least one axial fan 85, in this case in particular two axial fans 85, is/are arranged for controlling the temperature of interior space 35. Axial fans 85 are optionally designed and equipped to be frequency controlled. Thus, an appropriate temperature control of interior space 35, in particular of catalytic converter space 55, and/or a fresh air supply is always provided.

For clearer visibility of axial fans 5 and 80, catalytic converter system 39 is not shown in FIG. 5. This corresponds substantially to the view of catalytic converter space 55 after at least part of catalytic converter system 39 has been removed from the interior space 35, for example for maintenance purposes, in particular by way of rail arrangements 37.

This removal of catalytic converter system 39 or part of catalytic converter system 39, in particular of catalytic converter unit 41, can be carried out in the course of such maintenance work, in particular via large maintenance opening 17, in other words, front double door 19 shown on the left in FIG. 5.

Due to catalytic converter system 39, which is not shown, and in particular due to discharge path 45, which is not shown, an internal connecting pipe 87 of second opening 7 can also be seen in FIG. 5. This is arranged on the inside of second opening 7 and simplifies the assembly of discharge path 45 at second opening 7.

Compressed air device 62, in particular compressor 63, fresh air supply device 47 and/or axial fan 85 are optionally arranged in interior space 35 adjacent to one or more ventilation openings 33. In this way, the air requirement, in particular the fresh air requirement of these devices, can be covered in a reliable manner, wherein the design effort remains low.

Figure 6:
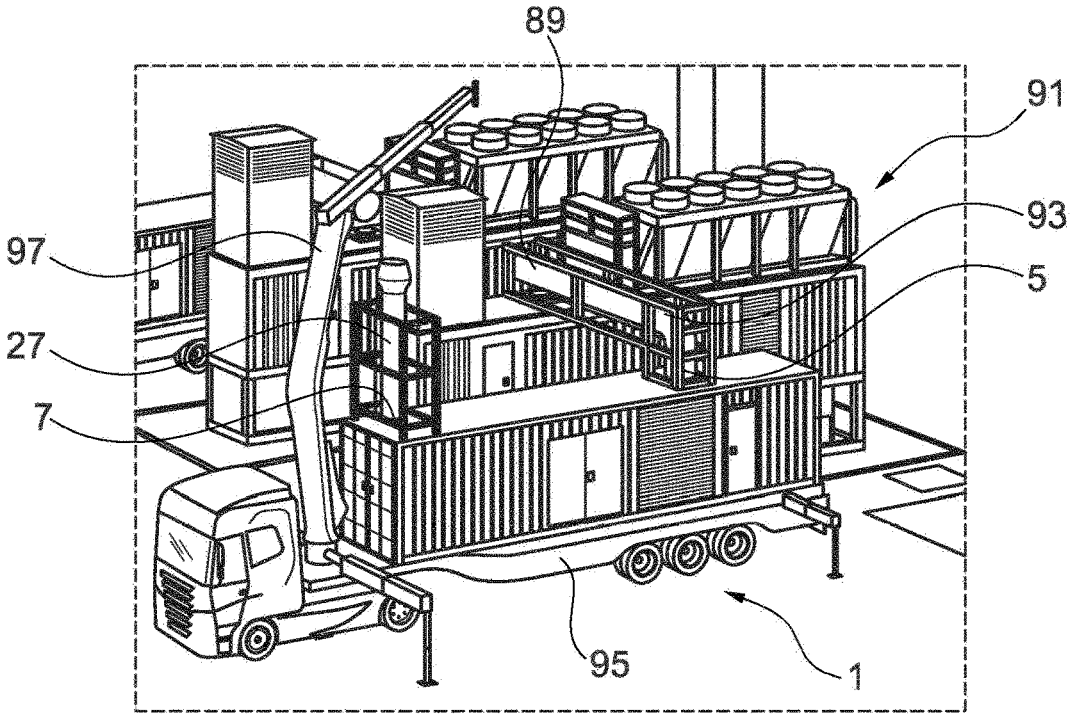
FIG. 6 is the exhaust gas after-treatment device in an operating state connected to an internal combustion engine.

FIG. 6 is a representation of exhaust gas after-treatment device 1 in the operating state, wherein an exhaust gas outlet 89 of an internal combustion engine 91 is connected via a connecting element 93 to first opening 5 of exhaust gas after-treatment device 1. Moreover, in the operating state shown here, exhaust gas stack 27 is installed at second opening 7. As a result, the exhaust gas of internal combustion engine 91, which is an internal combustion engine 91 that is installed optionally for stationary use, can be after-treated in particular temporarily and inexpensively.

The illustrated design example of exhaust gas after-treatment device 1 is arranged in particular on trailer 95. Exhaust gas after-treatment device 1 is designed optionally as a trailer 95, especially a truck trailer. Thus, exhaust gas after-treatment device 1 is highly mobile and can be used flexibly.

To simplify installation, in particular of exhaust gas stack 27 and connecting element 93, trailer 95 has an assembly crane 97. Thus, after relocation to a new location, the exhaust gas after-treatment device can be quickly and easily put into operation and can in particular be connected to internal combustion engine 91.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An exhaust gas after-treatment device, comprising:

a catalytic converter system, which includes a delivery side and a discharge side; and a container including an interior space, at least two openings, and a container top, the at least two openings including a first opening and a second opening, the catalytic converter system being arranged in the interior space of the container, the first opening being connected with the catalytic converter system on the delivery side, and the second opening being connected to the catalytic converter system on the discharge side, the first opening and the second opening being positioned at the container top.

2. An exhaust gas after-treatment device according to claim 1, further comprising a working platform, the working platform being arranged on the container top of the container.

3. An exhaust gas after-treatment device according to claim 2, wherein the working platform includes a non-slip floor.

4. An exhaust gas after-treatment device according to claim 2, wherein the working platform includes a foldable railing.

5. An exhaust gas after-treatment device according to claim 1, further comprising an exhaust gas stack which—at least in one operating state of the exhaust gas after-treatment device—is mounted outside of the container at the second opening.

6. An exhaust gas after-treatment device according to claim 1, wherein the container includes at least one rail arrangement, at least part of the catalytic converter system being movably located on the rail arrangement.

7. An exhaust gas after-treatment device according to claim 1, wherein the catalytic converter system includes a catalytic converter device, the catalytic converter system including a fresh air supply device configured for supplying a fresh air, the fresh air supply device including a first flow opening which is fluidically connected at least indirectly to the catalytic converter device of the catalytic converter system, and the fresh air supply device including a second flow opening which is structured and arranged for a fluidic connection with, and is fluidically connected with, a fresh air source.

8. An exhaust gas after-treatment device according to claim 1, wherein the catalytic converter system includes an SCR catalytic converter, the exhaust gas after-treatment device further including at least one reducing agent reservoir and a reducing agent supply line, the at least one reducing agent reservoir being arranged in the interior space of the container and being connected to the catalytic converter system via the reducing agent supply line.

9. An exhaust gas after-treatment device according to claim 8, further comprising a compressed air device, which is located in the interior space, is configured for injecting a reducing agent, and is operatively connected to reducing agent supply line.

10. An exhaust gas after-treatment device according to claim 1, further comprising a controller which is structured and arranged for controlling the catalytic converter system and is located in the interior space.

11. An exhaust gas after-treatment device according to claim 1, wherein the exhaust gas after-treatment device is a vehicle or a vehicle trailer.

12. An internal combustion engine, comprising:

an exhaust gas after-treatment device, including:

a catalytic converter system, which includes a delivery side and a discharge side; and a container including an interior space, at least two openings, and a container top, the at least two openings including a first opening and a second opening, the catalytic converter system being arranged in the interior space of the container, the first opening being connected with the catalytic converter system on the delivery side, and the second opening being connected to the catalytic converter system on the discharge side, the first opening and the second opening being positioned at the container top; and an exhaust gas outlet which is fluidically connected to the first opening of the exhaust gas after-treatment device.

* * * * *